US005184771A

United States Patent [19]

Jud et al.

[11] Patent Number: 5,184,771

[45] Date of Patent: Feb. 9, 1993

[54] PACKAGING FOR PIECE GOODS

[75] Inventors: Wilfried Jud, Obergrafendorf; Franz Reiterer, Neustift-Innermanz; Andreas Neiderer, St. Pölten-Wagram, all of Austria

[73] Assignee: Teich Aktiengesellschaft, Austria

[21] Appl. No.: 691,009

[22] PCT Filed: Oct. 29, 1990

[86] PCT No.: PCT/AT90/00105

§ 371 Date: Jun. 26, 1991

§ 102(e) Date: Jun. 26, 1991

[87] PCT Pub. No.: WO91/06488

PCT Pub. Date: May 16, 1991

[30] Foreign Application Priority Data

Oct. 27, 1989 [AT] Austria ..... 2478/89

[51] Int. Cl.[5] ..... B65D 75/20

[52] U.S. Cl. ..... 229/87.05; 229/237; 220/461; 206/524.2

[58] Field of Search ..... 229/87.05, 237; 206/608, 633, 484.2, 524.2; 220/270, 359, 453, 461; 428/212, 76, 43

[56] References Cited

U.S. PATENT DOCUMENTS

| | | | |
|---|---|---|---|
| 3,109,577 | 11/1963 | Knipp | 229/227 |
| 3,111,255 | 11/1963 | Skowronski | 229/227 |
| 3,405,861 | 10/1968 | Bush | 206/633 |
| 3,498,448 | 3/1970 | Kuster | 206/613 |
| 3,623,653 | 11/1971 | Work | 229/87.05 |
| 4,030,662 | 6/1977 | Gess | 229/40 |
| 4,209,126 | 6/1980 | Elias . | |
| 4,589,145 | 5/1986 | Van Erden et al. | 206/632 |
| 4,657,142 | 4/1987 | Mizoguchi et al. | 229/87.05 |
| 4,658,963 | 4/1987 | Jud | 206/633 |
| 4,726,473 | 2/1988 | Sato et al. | 229/87.05 |
| 4,811,848 | 3/1989 | Jud | 206/632 |
| 4,826,011 | 5/1989 | Jud | 229/87.05 |
| 4,955,479 | 9/1990 | Beer et al. | 206/484.2 |

FOREIGN PATENT DOCUMENTS

| | | | |
|---|---|---|---|
| 686320 | 5/1964 | Canada | 229/40 |
| 1948128 | 7/1970 | Fed. Rep. of Germany . | |
| 3612710 | 6/1987 | Fed. Rep. of Germany | 206/633 |
| 3545731 | 7/1987 | Fed. Rep. of Germany . | |
| 3836227 | 4/1990 | Fed. Rep. of Germany . | |
| 2558802 | 8/1985 | France | 206/633 |
| 651795 | 10/1985 | Switzerland . | |
| 1025623 | 4/1966 | United Kingdom . | |
| 1379996 | 1/1975 | United Kingdom . | |
| 2123376 | 2/1984 | United Kingdom | 206/633 |
| WO87/02011 | 4/1987 | World Int. Prop. O. . | |
| 8800562 | 1/1988 | World Int. Prop. O. | 206/608 |

*Primary Examiner*—Allan N. Shoap
*Assistant Examiner*—Christopher J. McDonald
*Attorney, Agent, or Firm*—Bacon & Thomas

[57] ABSTRACT

The invention concerns an essentially hermetic wrapping, in particular a tubular pouch wrapping, comprising two strip-like edge zones of the wrap material that are joined together by sealing, and two incisions 4, 18, 24, 28 are present in at least one of the two said edge zones, the wrap material forming a grip tab between said two incisions by means of which a tear-open region is pulled off when the wrapping is being opened. When a multi-layer wrap material is used of which the layers are selected from the series: paper, unstretched polyolefin foil or layer, aluminum foil, biaxially stretched polypropylene foil, biaxially stretched polyamide foil, biaxially stretched polyethleneterphthalate foil and a subassembly of two or three layers of the above materials bonded together with high peel strength, wherein this series the layers of material cited earlier always are nearer the wrapped good than those cited later, then when the wrappings are opened, starting from the incisions 4, 18, 24, 28, the wrap material tears along two approximately mutually parallel lines 8.

29 Claims, 4 Drawing Sheets

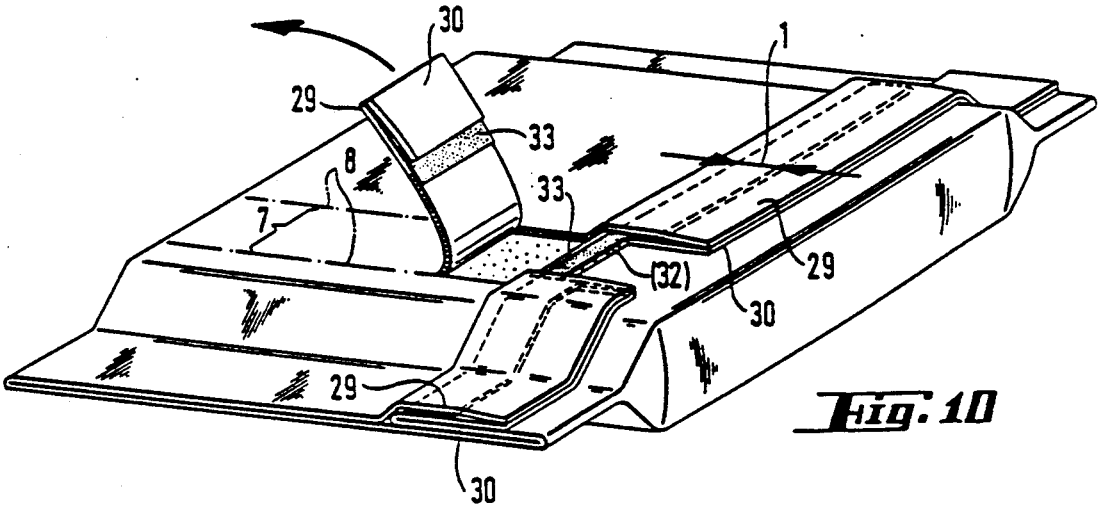
Fig. 10
Fig. 8
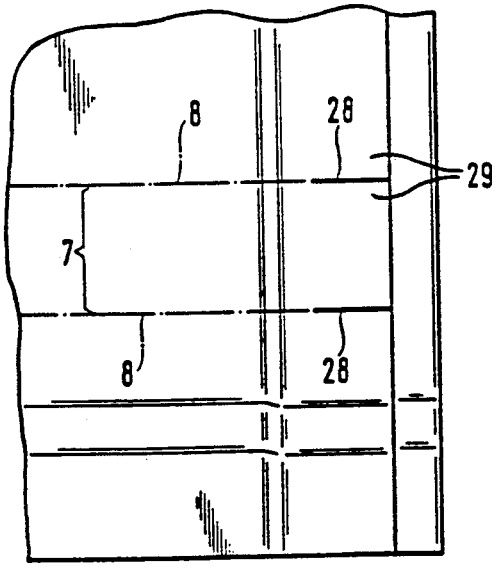
Fig. 9
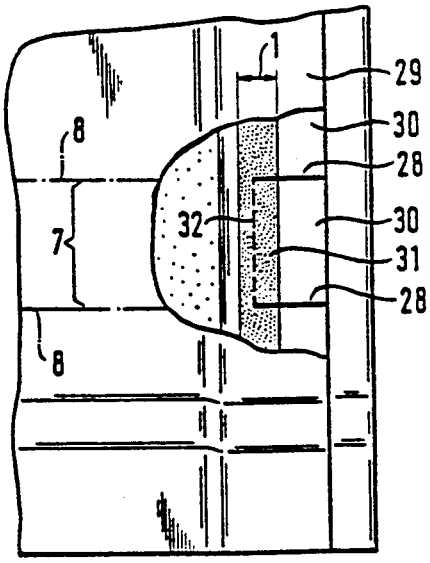

PACKAGING FOR PIECE GOODS

TECHNICAL FIELD

The invention concerns a package for piece goods, which comprises an envelope formed by an areal, foldable and multilayer wrap of which two strip-like edge zones are connected together by sealing, preferably cold-sealing, a connection area to form the envelope, a strip-shaped tear-open region of the envelope starting at one of the two strip-like edge zones to which it extends substantially perpendicularly.

STATE OF THE ART

A package of this kind is known from the published PCT application WO 80/02827 (Application No. PCT/AT80/00017) filed by applicant. In this known package—which advantageously consists of a two-layer wrap material and which is more or less in the form of a tubular pouch, the side edges of the tear-open region are formed by weakening lines present in the wrap material and along which the material tears when the package is opened. The beginning of the strip-like tear-open accessory is located in a doubling zone of the package, and as regards a tubular pouch therefore for instance at one of its flipper-shaped sealing spots. Because of the weakening lines introduced in special manner in the said doubling zone of the package, it can be torn open in problem-free manner while retaining its hermeticity. On the other hand the manufacture of packages containing weakening lines is comparatively expensive.

DESCRIPTION OF THE INVENTION

Hence it is the object of the invention to create a package of the initially cited kind where the wrap material used in making the package evinces little or no weakening lines and allows problem-free opening by removing a strip-like tear-open region.

The basic problem of the invention is solved by the package of the invention which is characterized in that the wrap material consists of several layers which are selected from the series: paper, unstretched polyolefin foil or layer, aluminum foil, biaxially stretched polypropylene, biaxially stretched polyamide foil, biaxially stretched polyethylene-terephthalate foil, and a sub-assembly of two or three layers possibly consisting of the above materials, where, in all adjacent different layers in the wrap material the one cited earlier in the series, and as regards adjacent layers of the same or similar material, the particular thinner one always is closer to the packaged good, and where the sub-assembly is such that bonding is present between its layers which is stronger than that existing between the sub-assembly and the other layers of the wrap material, and in that the wrap material comprises notchings or linear perforations and possibly weakening lines only inside the strip-like edge zone along the two side boundaries of the tear-open region but no weakening line or weaker material outside this edge zone, and in that a grip tap is present at the beginning of the tear-open region, consisting of same material as the package in the edge zones and being located between the notchings or linear perforations. Regarding packaging including a sub-assembly, advantageously the bonding between the individual layers of the sub-assembly evince peel-strengths 50% at least, preferably at least 70% more than those of the bonding between the sub-assembly and the other layers of the package.

Now applicant discovered in surprising manner that precisely as regards the above cited material combinations in the package, when removing the tear-open region of the package, starting from the ends of the notchings or linear perforations, the package will tear even in the absence of weakening lines along more or less parallel lines, that is, along the conceptual side edges of the tear-open region.

In an advantageous embodiment of the package of the invention, the notchings or linear perforations go as far at least as the connection area or into it.

In an advantageous embodiment of the invention, same is characterized in that the beginning of the tear-open region between the connection area and the free edge of one of the package edge zones shall form the grip tab.

In another advantageous embodiment of the invention, the package of same is characterized in that the free edge of the package the start of the tear-open region is folded at least inside the tear-open region to form a fold.

In a further advantageous embodiment of the package of the invention, same is characterized in that the notchings or perforations start at the free edge of the package, i.e. from the edge of the fold on the wrap-material edge.

In yet another embodiment of the invention, the package of the invention is characterized in that the seal layer of the connection area instead of the tear-open region comprises a clearance, in order to form or enlarge the grip tab, in at least one of the two mutually joined wrap material edge zones.

In another advantageous embodiment of the package of the invention, the edge zone which is not the beginning of the tear-open region comprises a cut-out starting at the free edge of this edge zone instead of the grip tab In still another advantageous embodiment of the invention, the package of this invention is characterized in that the seal bonding evinces less peel strength inside the tear-open region than elsewhere.

In a series of the above advantageous embodiment of the package of the invention, the grip tab is formed by the beginning of the strip-like tear-open region. As a result, when the pack is opened, the seal of the two mutually connected edge zones shall be peeled open.

In another advantageous embodiment of the invention, the package of the invention on the other hand is characterized in that notchings or linear perforations starting at the wrap-material edges or the edge of the fold at the wrap-material edge are present at both wrap-material edge zones joined together by the strip-like connection area, whereby the grip tab is formed by material from both edge zones. Advantageously the locations of the two notchings or perforations are connected in that edge zone where the tear-open region does not start by a linear material weakening in the wrap material which preferably is located inside the connection area of the two strip-like edge zones.

A last advantageous embodiment of the package of the invention is characterized in that is assumes the form of a tubular pouch for which the two material-wrap edge zones are joined together by their insides and thereby form the longitudinal seal seam of the tubular pouch, said seam being folded back on the surface of the wrapping envelope, the tear-open region starting at the edge zone which is outside but abutting the folded longitudinal seal seam.

BRIEF DESCRIPTION OF DRAWINGS

FIG. 8 is a partial top view of the wrapping;

FIG. 9 shows FIG. 8 but with a ruptured package envelope; and

FIG. 10 shows the package of FIG. 8 in a half open state.

SHORT DESCRIPTION OF THE DRAWINGS PERTINENT TO THE INVENTION IN RELATION TO SEVERAL ILLUSTRATIVE EMBODIMENTS

The invention is comprehensively discussed below in relation to the Figures, the wrap material being shown in exaggerated thickness for clarity of exposition.

In the following embodiment, the package is made from a two-layer wrap material. This wrap material when considered starting at the outside consists of a printed aluminum foil 0.007 to 0.009 mm thick with a specific weight of 30 to 100 g/m$^2$ and of a deposited cold-bonding layer with latex base (2 to 7 g/m$^2$). The paper forms the mechanical support layer of the compound material and the aluminum forms the layer assuring the hermeticity of the wrap material.

For each package to be made, two incisions are punched at the packaging machine at one of the edges of the length of wrap material pulled off the roll and immediately thereafter, to make the packages, the length of wrap-material is folded around the continuously advanced piece goods to be packaged, for instance waffles, their edges being sealed to each other within a strip-like connection area and the two mutually sealed edge zones, which are termed "fins", are so folded back on the package surface that the edge zone containing the incisions shall be external. The tube of wrap-material enclosing the packaged piece goods now is provided with two mutually parallel transverse sealing seams between every two consecutive wrapped piece goods and is divided by severing incisions between said transverse sealing seams into individual tube pouch packages. These transverse seals thereupon form the "flippers" of the tube pouch package projecting from the package envelope.

Figure 1:
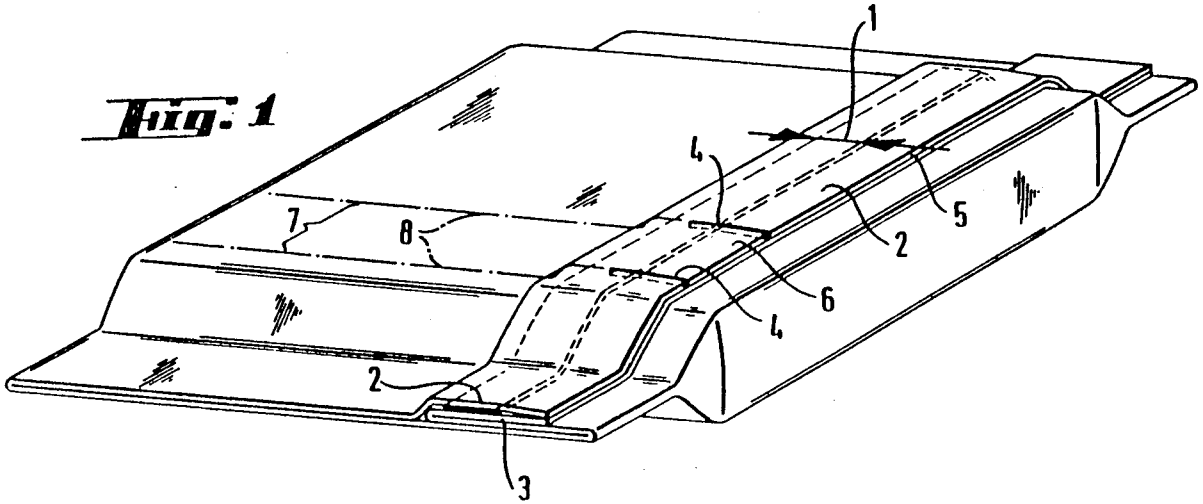
FIG. 1 is a perspective view of the package.

FIG. 1 is a schematic perspective of a tube pouch package made in this way for waffles. It indicates the mutually sealed wrap-material edge zones 2 and 3 inside a strip-like connection area 1, which as "fins" are folded back on the surface of the package envelope. The punched incisions 4 are present in the external edge zone 2 of the wrap material and extend from the edge 5 of the edge zone 2 as far as the connection area 1. The material of the edge zone 2 forms a grip tab 6 between these two incisions 4 that extends from the edge 5 as far as the connection area 1 and is large enough to be seized to open the package. As a result the package envelope comprises a strip-like tear-open region 7 of which the lateral boundaries are conceptual lines 8 at the package envelope and forming continuations of the incisions 4.

Figure 2:
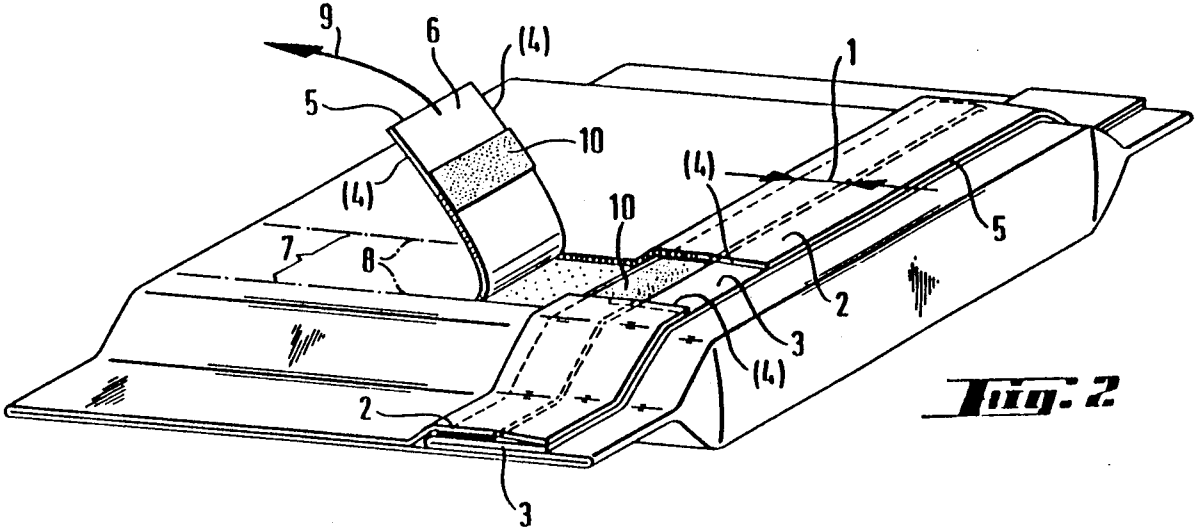
FIG. 2 shows the package in a half open state.

FIG. 2 shows the package similarly to FIG. 1, however in the half-open state. It indicates the two zones 10 of the separated cold seal. When further pulling the tear-open region 7 in the direction of the arrow 9, the opening of the package envelope is enlarged so much that the wrapped good can be removed without the structure of the package envelope being destroyed on account of its having been opened.

Now it was observed that the two-layer wrap-material used in this embodiment—which when starting from its outside essentially consists of an aluminum foil and a paper layer (the thin adhesive layers are not considered here being a separate layer) will tear approximately along the conceptual parallel lines 8 forming the conceptual lateral edges of the tear-open region. However this shall not be the case when using a wrap material for which the paper layer is outside and the aluminum foil is inside; when opening the otherwise identical package, the wrap material shall tear beginning at the incisions 4 and along two lines intersecting at a more or less acute angle; the opening created in the package envelope is quite inadequate.

This behavior is not immediately intelligible. However tests have shown that as regards multi-layer wrap materials selected from the materials of the following series, namely paper, unstretched polyolefin foil or layer (for instance polyethylene—PE), aluminum foil (Alu), a foil of biaxially stretched polypropylene (OPP), a foil of biaxially stretched polyamide (OPA), a foil of biaxially stretched polyethyleneterephthalate (PET) and a sub-assembly of two or three of the above materials—where, as regards all adjacent different layers in the wrap material, that which is cited earlier in the series, and, as regards adjacent layers of identical or similar material the particular thinner one, is nearer the packaged good—will tear along approximately parallel lines when the package is opened. The expression sub-assembly denotes a composite in which the bonding between its layers is substantially stronger than the bonding between this sub-assembly and the remaining layers of the wrap material.

Several Examples of material-wrap combinations in wrap-materials are listed below which are designed as shown in the direction from the outside to the inside, being furthermore provided with a thin coating of cold adhesive on the wrapping inside:

| | Layer of Material | Relevant Thickness or Sp. Weight |
|---|---|---|
| 1. | OPP | 20–40μ |
| | Alu | 7–12μ |
| 2. | PET | 12–20μ |
| | OPP | 12–25μ |
| 3. | OPP | 12–25μ |
| | paper | 12–60 g/m$^2$ |
| 4. | PET | 12–20μ |
| | PE foil | 20–70μ |
| 5. | PET | 12–20μ |
| | Alu | 7–12μ |
| | PE foil | 20–70μ |
| 6. | OPP | 12–25μ |
| | Alu | 7–12μ |
| | PE foil | 20–70μ |

Illustratively a wrap material which tears parallel in the wrapping of the invention and consisting of the following materials (from the outside to the inside), is listed below.

| | |
|---|---|
| OPP | 12–25μ |
| PE | 5–15μ |
| Alu | 7–12μ |
| OPP | 12–25μ |

The first three materials are bound together with a peel strength of 5.3 N/15 mm and form a sub-assembly which in turn is bonded to the innermost OPP foil with a peel strength of 2.6 N/15 mm. The said peel strengths each time denote the average tear strength in N/15 mm as carried out by testing described in VERPACKUNGS-RUNDSCHAU of September 1978, pp 72–3.

Several variations of the package of the invention are described below in relation to FIGS. 3 through 5, wherein opening is facilitated further by resorting to special steps.

Figure 3:
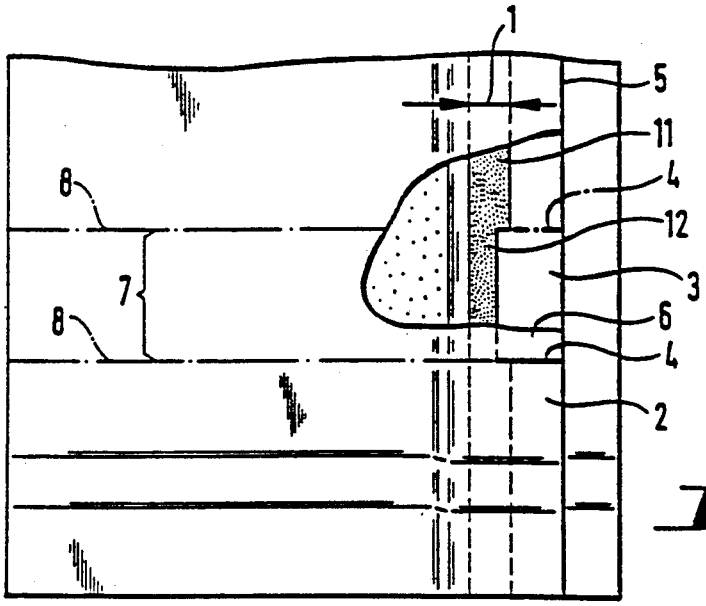
FIG. 3 is a partial top view of a variation of FIG. 1.

FIG. 3 is a partial top view of a variation of the package of FIG. 1, the package envelope being shown broken up in the tear-open region 7. To facilitate opening, the seal layer 11 of the connection area 1 comprises a clearance 12 whereby the seal layer 11 in this instance is narrowed and therefore peeling the tear-open region 7 during opening is made easier. Besides this step widens the grip tab.

Figure 4:
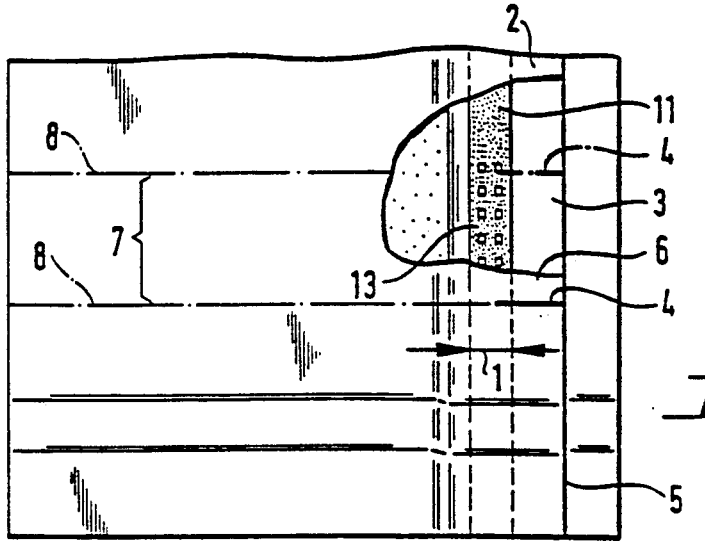
FIG. 4 shows a seal connection with a weakening zone.

FIG. 4 is a representation similar to FIG. 3 but shows another embodiment mode where the seal connection evinces a weakening zone 13 in the tear-open region 7, so that, when opening, the pealing of the tear-open region is facilitated. This weakening zone 13 preferably may be implemented in that the cold bond coating evinces illustratively in at least one of the edge zones 2 or 3 adhesive-free spots arrayed in a regular grid, thereby reducing the peeling strength of the seal connection.

Figure 5:
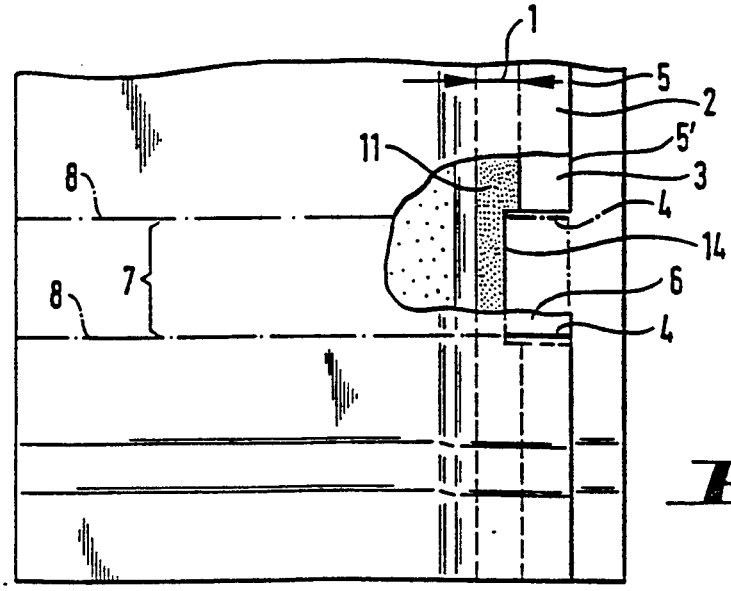
FIG. 5 shows the grip tab having a cut out to facilitate handling.

FIG. 5 is a representation similar to FIG. 3 of a further embodiment variation of the package. In this case, to facilitate handling the grip tab, a cut-out 14 is provided in the lower edge zone 3, starting from latter's edge 5'. Preferably the cutouts 14 are punched out of the edge of the incoming length of wrap material simultaneously with the implementation of the incisions 4.

In another variation of the package of the invention, the incisions 4 may be replaced by notchings in the wrap material that start also at the wrap-material edge 5. However the implementation of such incisions as a rule is costlier on account of the punching wastes than when punching merely through, but in general the handling of the grip tab is made easier by these notchings.

Figure 6:
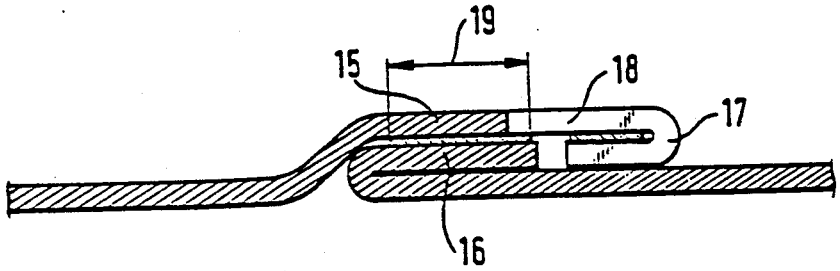
FIG. 6 shows the two wrap material in partial section.

FIG. 6 shows the two wrap-material edges in partial section along one of the two incisions for a variation of the package of FIG. 1. The upper edge zone 15 that is the beginning of the tear-open region is longer than the lower edge zone 16 and at its free wrap-material edge evinces a fold 17 fixed in place by cold sealing. The incisions 18 extend over the entire fold 17 as far as into the connection area 19 at the upper edge zone 15. The fold 17 therefore forms an especially easily handled grip tab between the two incisions 18.

When making this package, the fold 17 is continuously bent over and affixed by sealing to one edge of the length of wrap-material pulled off the roll immediately before the package machine, whereafter the two incisions 18 are introduced. The further manufacture of the package then takes place in a manner similar to that described in relation to FIG. 1.

Figure 7:
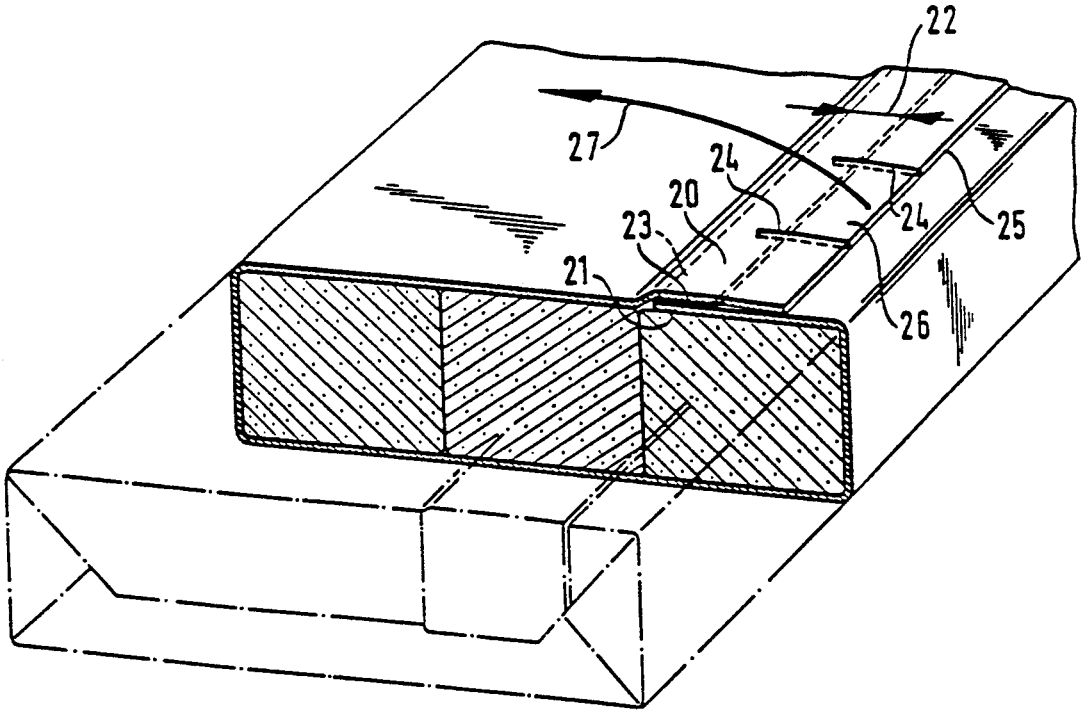
FIG. 7 is a partial perspective of a folded over pack.

However the package of the invention also may be advantageously varied to differ from a tubular pouch package. FIG. 7 is a section, i.e. a partial perspective of a fold-over package of the kind used mainly for goods to be completely baked, for instance waffles. This package comprises a wrap envelope made of an areal, foldable wrap material, with two edge zones 20 and 21 overlapping mutually and being connected to each other in a connection area 22 by means of an adhesive layer 23. Two incisions 24 are provided in the overlapping edge zone 20 and extend from the wrap-material edge 25 as far as into the connection area 22, a grip tab 26 being formed between the two incisions 24. The wrapping is opened similar to the case relating to FIGS. 1 and 2 by pulling the grip tab 26 in the direction of the arrow 27.

A last and advantageous variation of the package of the invention, namely in the form of a tubular pouch, is discussed below in relation to FIGS. 8 through 10. As regards this package, the two incisions 28 are present in the two joined edge zones 29 and 30. FIG. 8 is a partial top view of the wrapping and FIG. 9 is a similar representation, however in it the tear-open region is replaced by the ruptured package envelope. The lower edge zone 30 comprises a weakening line 32 inside the connection area between the two incisions and within the seal layer 31, said line 32 being parallel to said layer 31 and consisting for instance of several short perforations separated by bridges of material. When making the package, the incisions 28 and the weakening line 32 are punched into the length of wrap material immediately before it is fed to the wrapping machine.

In this wrapping variation the material of both edge zones 29, 30 in the area between the two incisions 28 forms the grip tab which when being peeled entails tearing open the wrap material along the weakening line 32. Thereupon the opening takes place while peeling off the residual area 33 of the seal connection and with further tearing of the wrap material along mutually approximately parallel lines similarly to the case described in relation to FIG. 2. FIG. 10 shows this package as a perspective and in the half opened state.

COMMERCIAL APPLICABILITY

The package of the invention is substantially hermetic and easily opened and can be used, preferably in the form of a tubular pouch package, to package chocolate, waffles or the like.

We claim:

1. A package for piece goods comprising a foldable, multilayer wrap material having two strip-like edge zones which are joined together in a connection area and cold sealed to form an envelope, said envelope including a strip-like tear open area starting from one of the two strip-like edge zones and extending essentially perpendicularly to this edge zone, wherein the wrap material is comprised of one of more layers of material selected from the group consisting of paper, unstretched polyolefin, aluminum foil, biaxially stretched polypropylene, biaxially stretched polyamide and biaxially stretched polyethyleneterephthalate and a sub-assembly of two or three layers of these materials, wherein the bonding between the layers of the sub-assembly is substantially stronger than the bonding between the sub-assembly and the remaining layers of the wrap material and wherein said cold seal exhibits a peel strength inside the tear-open area which is less than in other parts of the connection area.

2. The package defined in claim 1, wherein as regards all adjacent, different layers in the wrap material, the material which is to be closer to the piece goods is the material which appears first in the following list: paper, unstretched polyolefin, aluminum foil, biaxially stretched polypropylene, biaxially stretched polyamide and biaxially stretched polyethylene-terephthalate.

3. The package defined in claim 1, wherein as regards adjacent layers of the same or similar material, the layer which is to be closer to the packaged piece goods is thinner than the other layer of the same or similar material in the package.

4. The package defined in claim 1 wherein the strip-like tear open area has weakening lines inside said edge zone.

5. The package defined in claim 1, further comprising a grip tab at the beginning of the tear-open area between said notchings or linear perforations.

6. The package defined in claim 1, wherein the notchings or linear perforations start at the free edge of the wrap material.

7. The package defined in claim 1, wherein the bonding between individual layers of the sub-assembly exhibit peel strengths at least 50% higher than the peel strengths of the bonding between the sub-assembly and the remaining layers of the wrap material.

8. The package defined in claim 1, wherein the notchings or linear perforations extend at least to the connection area.

9. The package defined in claim 8, wherein the notchings or linear perforations extend into the connection area.

10. The package defined in claim 5, wherein the beginning of the tear-open area between the connection area and a free edge of one of the wrap material edge zones forms the grip tab.

11. The package defined in claim 1, wherein a free wrap-material edge is bent back at least inside the tear-open area to form a fold at the edge zone which is the beginning of the tear-open area.

12. The package defined in claim 5 wherein a portion of the connection area is unsealed in the tear-open area to form or enlarge the grip tab.

13. The package as defined in claim 1, wherein said seal is formed by an adhesive.

14. The package as defined in claim 1, further comprising notchings or linear perforations present on both edge zones of the wrap material joined together at the connection area, such that material from both edges zones forms a grip tab.

15. The package defined in claim 1, wherein said package is in the form of a tubular pouch and wherein said two edge zones of the wrap material are joined together along their inside surfaces to form the longitudinal seam of said tubular pouch, said seam being folded back on the surface of the package and the tear-open area starting at the edge zone which is on the outside of the folded-back longitudinal seam.

16. A package for piece goods comprising a foldable, multi-layer wrap material having two strip-like edge zones which are joined together in a connection area and sealed to form an envelope, said envelope including strip-like tear open area starting from one of the two strip-like edge zones and extending essentially perpendicularly to this edge zone, said wrap material comprising one or more layers of material selected from the group consisting of paper, unstretched polyolefin foil or layer, aluminum foil, biaxially stretched polypropylene foil, biaxially stretched polyamide foil, biaxially stretched polyethyleneterephthalate foil and a subassembly of two or three layers of these materials, wherein as regards all adjacent, different layers in the wrap material, the material which is to be closer to the packaged piece goods is the material which appears first in said group and as regards adjacent layers of the same or similar material, the layer which is to be closer to the packaged piece goods is thinner than the adjacent layer of the same or similar material, wherein the bonding between the layers of the sub-assembly is substantially stronger than the bonding between the sub-assembly and the remaining layers of the wrap material, said tear open area having two lateral boundaries along which notchings or linear perforations are provided only inside the strip-like edge zone such that outside the strip-like edge zone there are no notchings or perforations.

17. The package defined in claim 16, further comprising a grip tab at the beginning of the tear-open area between said notchings or linear perforations.

18. The package defined in claim 10, wherein the strip-like tear open area has weakening lines inside said edge zone.

19. The package as defined in claim 16, wherein the notchings or linear perforations start at the free edge of the wrap material.

20. The package defined in claim 16, wherein the bonding between individual layers of the sub-assembly exhibit peel strengths at least 50% higher than the peel strengths of the bonding between the sub-assembly and the remaining layers of the wrap material.

21. The package defined in claim 16, wherein the notchings or linear perforations extend at least to the connection area.

22. The package defined in claim 21, wherein the notchings or linear perforations extend into the connection area.

23. The package defined in claim 17, wherein the beginning of the tear-open area between the connection area and a free edge of one of the wrap material edge zones forms the grip tab.

24. The package defined in claim 16, wherein a free wrap-material edge is bent back at least inside the tear-open area to form a fold at the edge zone which is the beginning of the tear-open area.

25. The package defined in claim 17, wherein a portion of the connection area is unsealed in the tear-open area to form or enlarge the grip tab.

26. The package as defined in claim 16, wherein said seal is formed by an adhesive.

27. The package as defined in claim 16, further comprising notchings or linear perforations present on both edge zones of the wrap material joined together at the connection area, such that material from both edge zones forms a grip tab.

28. The package defined in claim 16, wherein said package is in the form of a tubular pouch and wherein said two edges zones of the wrap material are joined together along their inside surfaces to form the longitudinal seam of said tubular pouch, said seam being folded back on the surface of the package and the tear-open area starting at the edge zone which is on the outside of the folded-back longitudinal seam.

29. A package for piece goods comprising a foldable, multi-layer wrap material having two strip-like edge zones which are joined together in a connection area and sealed by an adhesive to form an envelope, said envelope including strip-like tear open area starting from one of the two strip-like edge zones and extending essentially perpendicularly to this edge zone, said wrap material comprising one or more layers of material selected from the group consisting of paper, unstretched polyolefin foil or layer, aluminum foil, biaxially stretched polypropylene foil, biaxially stretched polyamide foil, biaxially stretched polyethyleneterephthalate foil and a subassembly of two or three layers of these materials, wherein as regards all adjacent, different layers in the wrap material, the material which is to be closer to the packaged piece goods is the material which appears first in said group and as regards adjacent layers of the same or similar material, the layer which is to be closer to the packaged piece goods is thinner than the adjacent layer of the same or similar material, wherein the bonding between the layers of the sub-assembly is substantially stronger than the bonding between the sub-assembly and the remaining layers of the wrap material, and tear open area having two lateral boundaries along which notchings or linear perforations are provided only inside the strip-like edge zone such that outside the strip-like edge zone there are not notchings or perforations and wherein said seal exhibits a peel strength inside the tear-open area which is less than in other parts of the connection area.

* * * * *